United States Patent [19]

Bedell

[11] 4,394,006

[45] Jul. 19, 1983

[54] MOLTEN METAL FLOW CONTROL

[75] Inventor: John R. Bedell, Madison, N.J.

[73] Assignee: Electric Power Research Institute, Inc., Palo Alto, Calif.

[21] Appl. No.: 367,031

[22] Filed: Apr. 7, 1982

[51] Int. Cl.[3] ..... B22D 39/06

[52] U.S. Cl. ..... 266/239; 222/603; 222/595; 164/413

[58] Field of Search ..... 266/236, 239; 222/603, 222/591, 595; 164/413, 133, 449, 154; 65/130

[56] References Cited

U.S. PATENT DOCUMENTS

| | | | |
|---|---|---|---|
| 2,062,620 | 12/1936 | Stewart | 65/130 |
| 2,713,705 | 7/1955 | Lapin | 222/595 |
| 3,094,135 | 6/1963 | Ponsar | 137/240 |
| 3,200,457 | 8/1965 | Wagstaff | 222/590 |
| 3,253,307 | 5/1966 | Griffiths et al. | 222/590 |
| 3,499,580 | 3/1970 | Smith | 222/595 |
| 4,199,087 | 4/1980 | Golas et al. | 222/603 |
| 4,340,160 | 7/1982 | van Geel et al. | 222/595 |

*Primary Examiner*—L. Dewayne Rutledge
*Assistant Examiner*—Christopher W. Brody
*Attorney, Agent, or Firm*—King and Liles

[57] ABSTRACT

Metal flow control for a continuous casting process is provided by providing a gas back pressure bubble to block the flow of molten metal above the casting nozzle. Pressurized gas is provided to a cap positioned upstream of the nozzle and including a depending skirt that cooperates with a dam. When the gas pressure offsets the head pressure of the molten metal, the flow of molten metal into the nozzle is blocked. By terminating the control pressure, the flow of metal over the dam may be reestablished. The cap including the skirt and the dam form a weir assembly defining a channel along one side or around the periphery of the nozzle. The cap may be supported and fed with gas pressure through a duct from the side, or along the center of the crucible.

11 Claims, 5 Drawing Figures

Fig. 3
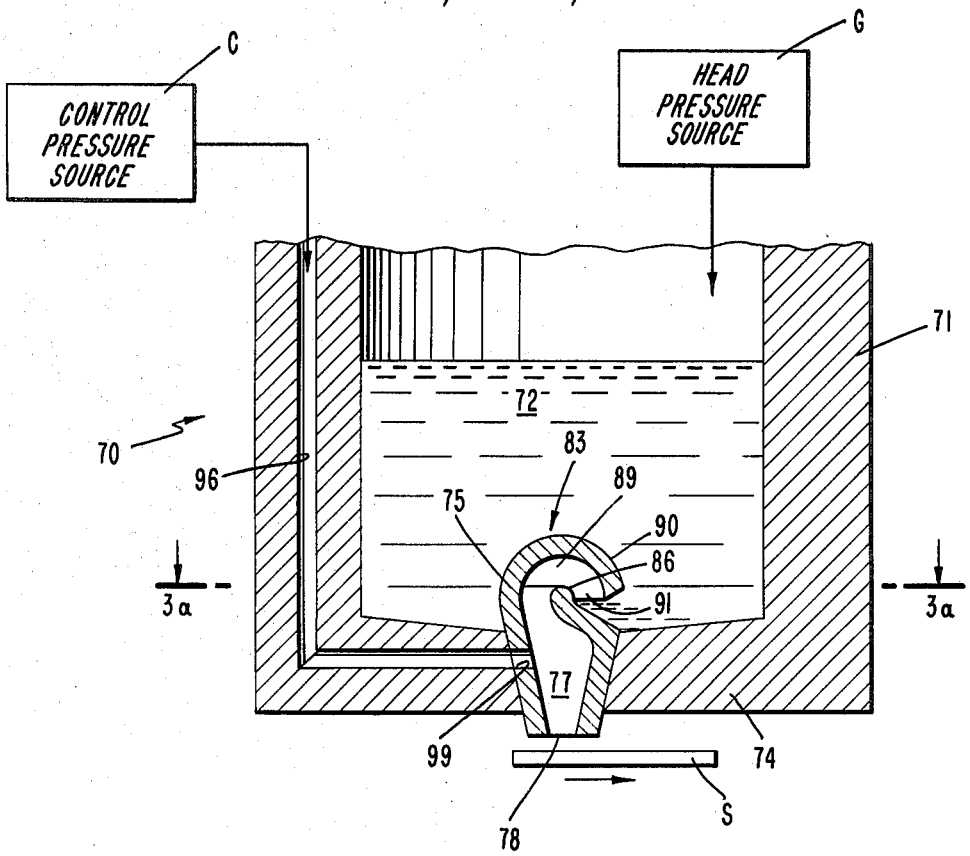
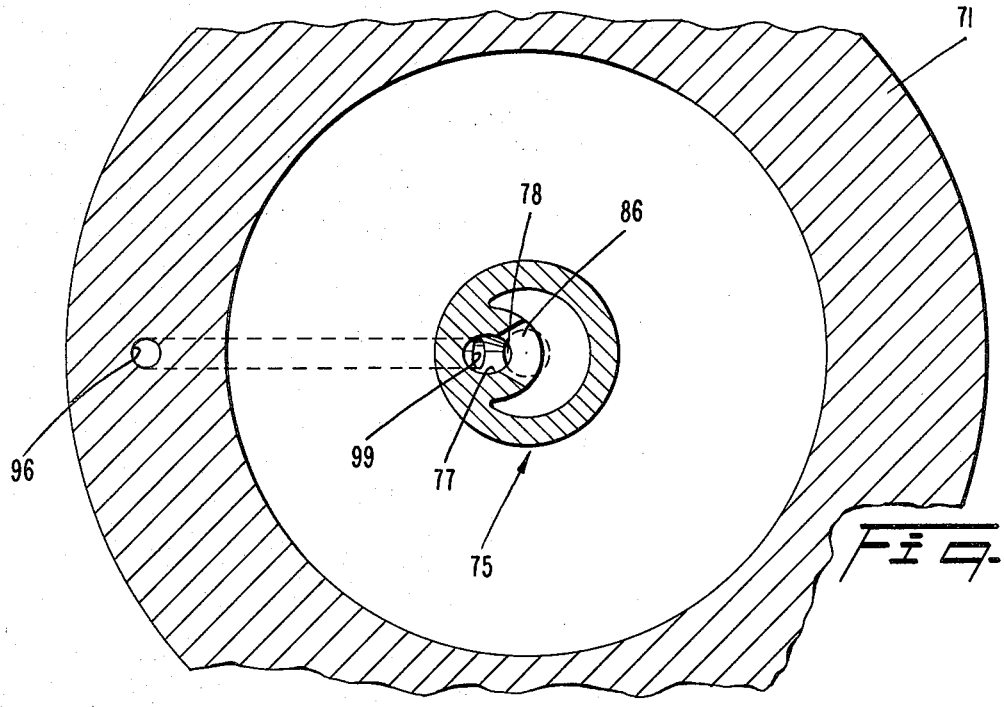
Fig. 3a

MOLTEN METAL FLOW CONTROL

TECHNICAL FIELD

This invention relates to an apparatus for controlling flow of molten metal from a container for continuous casting or the like. More particularly, the invention concerns a technique of selectively applying a pressurized gas flow for controlling the molten metal flow from a casting nozzle mounted in a container.

BACKGROUND ART

Known techniques for controlling molten metal flow from ladles, crucibles, and like vessels generally rely on the use of stoppers mechanically positionable in the discharge nozzle. Typical is the device disclosed in U.S. Pat. No. 3,200,457 to Wagstaff. Also, in U.S. Pat. No. 3,253,307 to Griffiths et al, there is disclosed a plug at the end of a shiftable stopper for seating in the discharge nozzle of the vessel.

Disclosure in U.S. Pat. No. 4,199,087 to Golas et al relates to a further exemplary stopper in the form of a sliding gate valve. A cut-off gate slides across the passage through which molten metal is otherwise dischargeable from the vessel.

Also included in the disclosure of the foregoing patents is the concept of use of pressurized gas to regulate the discharge of the molten metal through the nozzle. Griffiths et al is of particular interest in its disclosure of gas injected into the nozzle orifice uniformly around the periphery of the orifice. This action confines and reduces the diameter of the stream, and thus reduces the rate of metal discharge. Nonetheless, the Griffiths et al application of the gas to the casting nozzle is not intended to control the full on and off flow of the molten metal. To the contrary, Griffiths et al specify that the gas injection rate remains below that at which irregularity or breakup of the streamline flow of molten metal through the nozzle occurs.

The prior art thus fails to provide a gas pressure on-off control of molten metal flow. Utilization of gas pressure in the known prior art of molten metal feed is clearly directed only to regulating a sustained flow with reliance on mechanically operated devices to cut off such flow.

DISCLOSURE OF THE INVENTION

It is accordingly an object of the present invention to provide a simplified apparatus for control of flow of molten metal from a crucible.

It is yet another object of the present invention to provide a casting nozzle for on-off control of the flow of molten metal from the nozzle, without use of moving parts.

It is a more specific object of the present invention to provide an apparatus for providing a gas back pressure bubble adjacent the casting nozzle for total control of the flow of molten metal from a crucible.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

In accordance with these and other objects, the present invention provides an apparatus to facilitate on-off flow control over ejection of molten metal from a crucible in planar flow casting or jet casting of amorphous metal alloys; although other uses will become evident from the disclosure.

The crucible of the invention holds molten metal to be ejected for casting through a nozzle. Distinguishing the invention is the concept of total, that is, blocking, control over the flow state of the molten metal at the nozzle in response to pressurized gas. In effect, control is obtained without any moving parts, such as a stopper or a sliding gate, as in the prior art.

More specifically, flow to the nozzle is blocked with a gas pressure flow creating a back pressure bubble acting in a weir assembly upstream of the nozzle. The feed or discharge of the molten metal is physically controlled by a dam forming a part of the weir assembly positioned adjacent to the entrance orifice to the nozzle.

To cut off or block the metal flow, the back pressure is set so as to offset the head pressure in the crucible, so that the molten metal is held below the upper rim of the dam by the gas back pressure bubble in a cap overlying the dam. The cap also forms a portion of the weir assembly. A source or pressurized inert gas, such as nitrogen, feeds the cap with the desired gas pressure to form the blocking back pressure bubble. Reduction of the gas pressure in the weir assembly and nozzle to below that of the head of molten metal in the crucible allows the molten metal to spill over the dam and find passage through the nozzle. It follows that full flow is attained when the gas pressure is eliminated. When desired, reapplication of a blocking pressure reinstates the blocking gas flow, cutting off flow of metal to the nozzle, such as at the end of a casting run.

The concept of the present invention is particularly adapted to planar flow casting. The lips of the casting nozzle are positioned closely adjacent the casting substrate to form a restricted outlet. This provides greater back pressure for a given flow of gas through the nozzle. Consequently, the back pressure bubble blocking the flow of molten metal is easier to establish and maintain.

The flow of gas through the cap and thence out the nozzle after the casting run advantageously serves to flush the nozzle. Furthermore, continuous flushing may be desirable for preventing dust entry between runs.

The use of the gas flow of the present invention for cut off of metal flow also allows a precise casting pressure limit to be set to prevent casting from commencing before sufficient proper casting pressure is achieved in the crucible. Similarly, this precise control prevents casting from continuing after casting pressure becomes too low for efficient casting.

The weir assembly may take several forms in accordance with the invention. The gas pressure cap may be separate from the dam and nozzle, and suspended from either the side or the top of the crucible. The dam may be separate or integral with the nozzle. In one embodiment, are all integral. In this embodiment, the cap may be semi-spherical, hemispherical or the like, and the dam is formed by an indented wall on one side.

BRIEF DESCRIPTION OF THE DRAWING

The accompanying drawing incorporated in and forming a part of the specification, illustrates several aspects of the present invention, and together with the description serve to explain the principles of the invention. In the drawings:

FIG. 2 and FIG. 3 are partial vertical sectional views of two additional embodiments of molten metal crucibles having in combination discharge nozzles and weir assemblies in accordance with the present invention; and FIG. 3*a* is a view of a planar section taken along line 3*a*—3*a* in FIG. 3 illustrating the weir assembly, and the nozzle from above.

BEST MODES OF CARRYING OUT THE INVENTION

Figure 1:
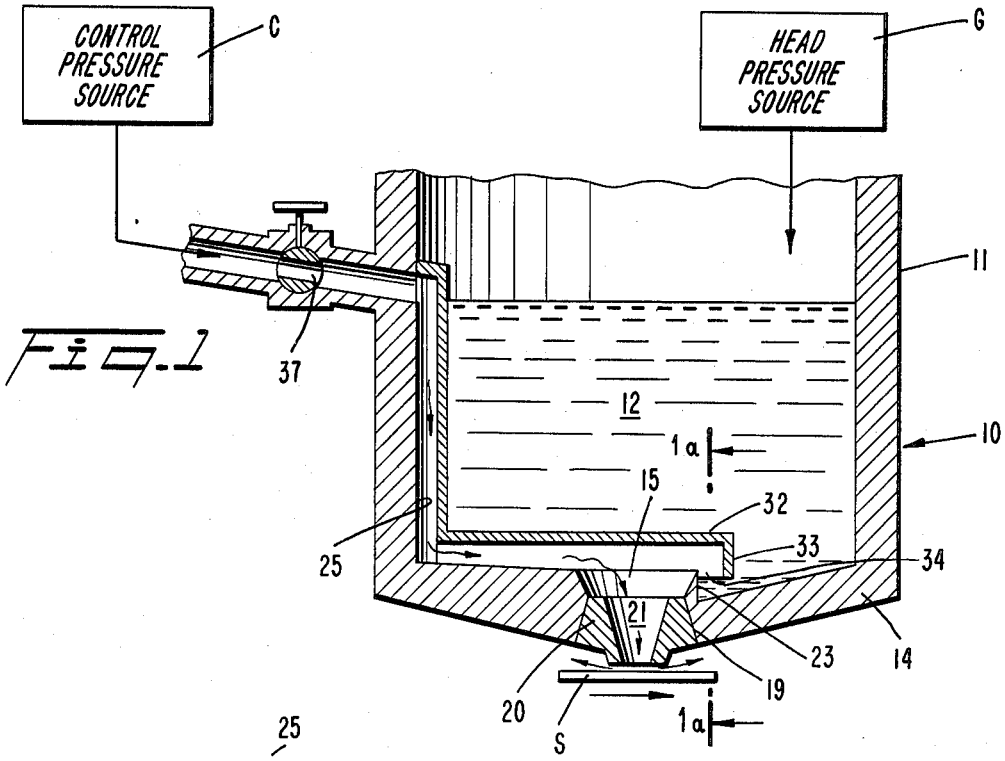
FIG. 1 is a partial vertical sectional view of a molten metal crucible having a discharge nozzle in combination with one embodiment of the present invention.

A crucible 10 shown in FIG. 1 is represented as a cylindrical refractory shell 11 to retain a charge of molten metal 12. Shell 11 has a generally conical base 14 with a tapered opening 15. Below the opening 15 is a lower conical recess 19. Affixed within lower recess 19, is a discharge nozzle 20 having a downwardly tapered central bore 21 terminating in an outlet orifice adjacent a casting substrate S. The opening 15 is formed on one side by a dam 23 rising from the bottom of the crucible.

Figure 1A:
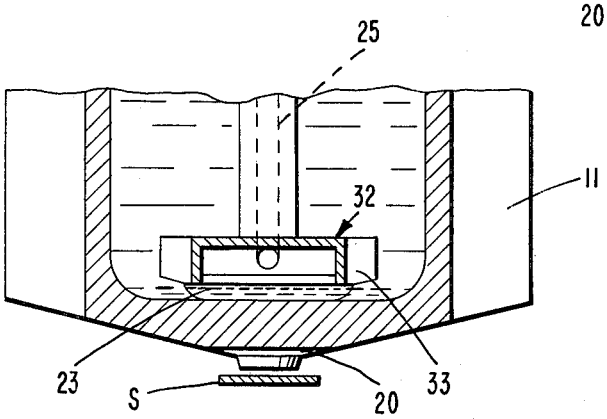
FIG. 1*a* is a partial sectional view taken along lines 1*a*—1*a* in FIG. 1 illustrating the weir assembly in more detail.

An internal duct 25 runs down along the inner wall of shell 11 and continues along an inner surface of the base 14. Duct 25 terminates within the crucible 10 by feeding into a cap 32 above the dam 23 and nozzle 20 (see FIGS. 1, 1*a*).

Cap 32 is thus centrally disposed and constitutes a hood above the opening 15. An arcuate skirt 33 of the cap is positioned in alignment with but spaced from the dam 23. The lower edge of the skirt 33 is positioned above the bottom of the crucible and thus defines a slot-like channel 34.

During casting, the molten metal 12 in the crucible flows under the skirt 33 through the channel 34 and over the dam 23, thus establishing the flow path of the metal to the opening 15 and through the nozzle 20. In effect, the cap 32 including the skirt 33 in combination with the dam 23 constitute a weir assembly providing the desired flow control function for the molten metal flow, as will be seen in more detail below.

For controlling the flow of molten metal at the weir assembly, the duct 25 is supplied with gas flowing under pressure to the cap 32. The gas flows into opening 15 and through the bore 21 of nozzle 20. The gas is partially blocked by the casting substrate S thereby forming a back pressure in the weir assembly 23, 32. With the molten metal 12 present in the crucible 10, a gas back pressure bubble is formed tending to block the metal at the channel 34. Suitable non-oxidizing or inert gases, such as nitrogen or argon are utilized.

Back pressure of the gas flow may be adjusted by positive control of valve 37. The level of back pressure to attain efficient on-off control over molten metal flow through nozzle 20 is obtained by simple adjustment of the inlet valve 37. More specifically, flow through nozzle 20 is stopped when the adjusted back pressure of gas flowing through the cap 32 is maintained greater than that exerted by the hydrostatic and/or pressured head of molten metal at channel 34. Reestablishment of the metal flow is attained by simply cutting off the gas pressure by the valve 37. This action allows the hydrostatic and/or pressurized head exerted above the molten metal to start the flow, thereby resuming the casting process.

Another advantage of the apparatus of the present invention is that the gas entering through the duct 25 is preheated by the molten metal 12 assuring the nozzle 20 remains at the proper working temperature for efficient casting immediately upon initiation of a casting run. Furthermore, when the flow of molten metal through the channel 34 is completely stopped, as shown in FIG. 1, the continued flow of gas through the nozzle 20 advantageously serves to flush the nozzle and can be continued between casting runs to prevent dust from entering the nozzle and contaminating the surfaces.

The flow of gas is preferably restricted in the space between the casting lips of the nozzle 20 and the substrate S, as shown by the flow arrows in FIG. 1. This arrangement is known in the art as planar flow casting and assures minimization of the amount of gas necessary to establish the back pressure bubble in the cap 32 and thereby hold the molten metal at the interface in channel 34.

The gas pressure acting on the surface of the molten metal 12 from pressure source G is closely controlled during the entire casting operation. The gas pressure is particularly important to establish the casting pressure at the beginning of a casting run in order to establish the proper molten metal puddle on the substrate S. The apparatus of the present invention is particularly useful in assuring that this precise casting pressure is reached before casting commences. In other words, the valve 37 is opened providing sufficient back pressure assuring maintenance of the blocking back pressure bubble in the cap 32 to maintain the molten metal/gas interface in the channel 34 (see FIG. 1). Only when the proper threshold pressure is reached, is the molten metal released from the nozzle.

Similarly, precise positioning of valve 37 can provide control of the molten metal flow at the end of a casting run. As the head of the molten metal 12 decreases, there is a point where the pressure is too low to safely fill the bore 21 of the nozzle 20 without possible voids, and casting at this point must be terminated. As the pressure of the molten metal in the channel 34 is reduced, the threshold pressure within the cap 32 where blocking occurs is reestablished, and the flow of metal is advantageously cut off before a problem develops.

In practice, the gas pressure in the duct 25 during the operation of the invention with planar flow casting, preferably is set in the range of $\frac{1}{4}$ lb/in$^2$ to 5 lb/in$^2$. In other words, at the lower end or with pressure off, metal is flowing providing casting on the moving substrate S, and at the higher part of the range, the flow of molten is cut off by being blocked by the weir assembly 23, 32. For jet casting of metal, the pressure range is approximately 10 lb/in$^2$–17 lb/in$^2$. The higher pressures required are due to the higher head pressures provided for jet casting by the increased gas pressure from the gas pressure source G. As indicated above, the positioning of the casting substrate S, such as a moving copper belt in close proximity to the lips defining the outlet orifice of the nozzle 20 allows the required back pressure to be reached with a minimum outflow of gas. Thus, the closer the substrate S to the casting lips of the nozzle 20, the easier it is to establish the required back pressure bubble within the cap 32 to block the molten metal flow.

Figure 2:
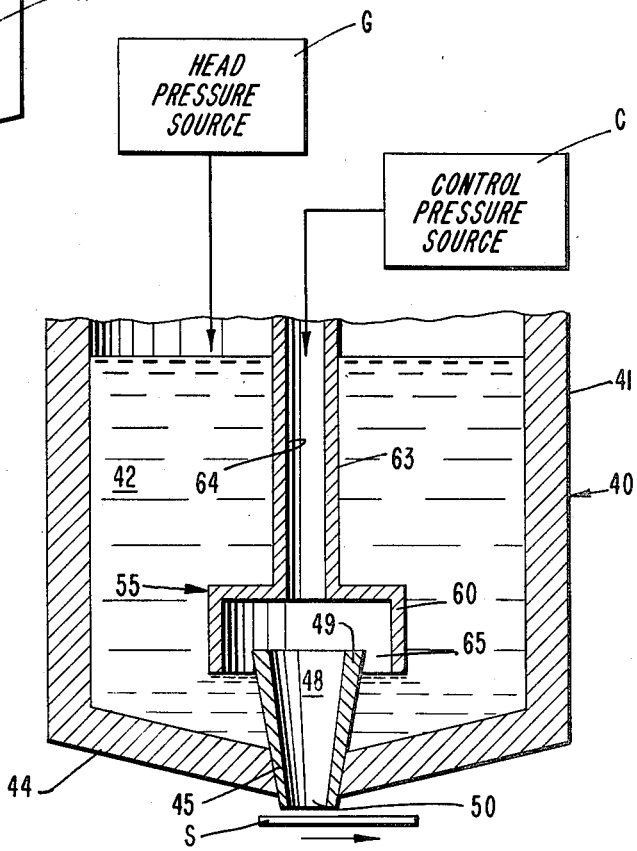

An alternative embodiment of the flow control apparatus of the present invention is shown in FIG. 2 of the drawings. Specifically, a crucible 40 is provided including a shell 41 and a base 44, corresponding to the crucible of the FIG. 1 embodiment as can be readily seen. A nozzle 45 is provided in the base 44 including a tapered discharge bore 48 through which the metal flows during casting. An upper edge 49 of the nozzle defines the inlet opening to the bore 48 and also, as will be more readily apparent below, forms a peripheral dam to assist in controlling the flow of the molten metal 42. The bottom of the bore 48 defines an outlet casting orifice 50.

Positioned above the nozzle 45 is a cap 55 substantially centrally located within the crucible 40. The cap 55 includes a depending skirt 60, the lower peripheral edge of which extends below the peripheral dam 49 (see FIG. 2). The cap 55 is centrally supported by a depending tube 63 having a duct 64 for supplying the gas pressure to cut-off the flow of molten metal. Of importance to this embodiment is the fact that a peripheral channel 65 is provided between the peripheral dam 49 and the lower edge of the skirt 60 as opposed to the single side dam 23, described above.

Thus, in operation of the embodiment of FIG. 2, the molten metal 42 is forced through the annular channel 65 by the combination of gas and molten metal head pressure within the crucible 40. The control pressure from pressure source C is provided through duct 64, filling the cap 55, and blocking the flow of molten metal 42 at the interface in the annular channel 65. The back pressure from the outlet orifice 50 generates and sustains a back pressure bubble within the cap 52 preventing metal from rising above the dam 49 and entering the bore 48. When the commencement of casting is desired, the pressure from pressure source C is simply cut off thus allowing molten metal to rise through the channel 65 between the skirt 60 and the dam 49, fill the bore 48 and flow through the outlet orifice 50 onto the casting substrate S.

During casting with this embodiment, the molten metal flows around the full periphery of the dam 49, filling of the bore 48 is assured and a high quality cast strip or ribbon is assured.

With reference now to FIGS. 3 and 3*a*, another alternative embodiment is shown wherein the weir assembly and the nozzle are all integral providing significant economies in terms of manufacture as well as replacement. Thus, a crucible 70 including a shell 71 holding a supply of molten metal 72 and including a base 74 is illustrated. A composite nozzle 75 incorporates the functions of the nozzle as well as the weir assembly, just described.

The nozzle 75 includes bore 77 terminating in casting orifice 78 above the casting substrate S. Cap 83 is formed by the upper portion of the composite nozzle 75 and an integral dam 86 is provided on one side of the nozzle and terminates centrally within hollow dome 89, formed by the cap 83 (see FIG. 3). A depending skirt 90 is formed on the same side of the composite nozzle 75 as the dam 86 and forms channel 91 for allowing flow of the molten metal through the dome 89, thence into the bore 77 and out the casting orifice 78.

To provide the blocking function of the casting metal flow, substantially as set forth in the previous embodiments, a duct 96 extending along one side of the shell 71 and connected to the control pressure source C, feeds the gas pressure through connecting gas orifice 99 into the bore 77. When the control pressure is thus supplied, the gas is partially blocked from exiting the casting opening 78 by the substrate S, and backs up into the hollow dome 89, thereby providing a gas back pressure bubble to expel or prevent metal from entering the nozzle through the channel 91. As the pressure from source C is balanced against the head pressure from source G, the molten metal interface is formed in the channel 91 and the flow of casting metal is effectively cut off. When the casting run is to be started, the pressure from source C is simply interrupted, thereby allowing the flow of metal through the channel 91 to commence, thus casting onto the substrate S, as desired.

As will be realized, since the composite nozzle 75 is a single piece, it can be easily cast of ceramic. The contours of the nozzle, especially between the dam 86 and the depending skirt 90, can be varied to match the viscosity and other parameters of the particular metal being cast at any particular time. Between casting runs, a new nozzle can be easily inserted by simply removing the old nozzle by forcing the nozzle upwardly to break the seal with the tapered hole in the base 74, and simply inserting a new nozzle from inside the crucible 70. Of course, the opening 99 is aligned with the duct 96 as the nozzle is placed in position.

In summary, numerous benefits have been described and shown which result from employing the concepts of the invention, either in the embodiments shown or in other obvious embodiments. Control of the molten metal flow through a nozzle in the bottom of a crucible is obtained by a back pressure bubble acting in a weir assembly upstream of the casting nozzle. The weir assembly includes a cap 32, 55, 83 and the associated dam 23, 49, 86 in the nozzles 20, 45, 75, respectively. By simply controlling the gas pressure from source C, the gas back pressure bubble can be used to completely cut off the flow from the nozzles. The back pressure bubble is sustained within the caps by restricted flow from the outlet orifice against the casting substrate S. Advantageously, the control is provided without moving parts and provides in all embodiments very responsive cut off of the flow since the control point is right at the nozzle.

The foregoing description of the preferred embodiment, and the alternative embodiments, of the invention is presented for purposes of illustration and description. It is not intended to be exhaustive or to limit the invention to the precise forms disclosed. Obvious modifications or variations are possible in light of the above teachings. For example, the dam 23 in the FIG. 1 embodiment may be made integral with the nozzle 20 and by the same token the dam 86 in the FIG. 3 embodiment may be formed in the base 74 of the crucible. Further, in any of the embodiments, the casting nozzle is preferably held in the base of the crucible in a tapered opening, and the opening can either taper toward the inside, as shown in FIG. 1, or toward the outside as shown in FIGS. 2 and 3. Thus, the embodiments are chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A flow control device for supplying molten metal from a crucible or the like for a continuous casting operation or the like comprising:

nozzle means for receiving and discharging metal flow for casting;

a weir upstream of the nozzle discharge for controlling metal flow through said nozzle means; and means for selectively applying pressurized gas against inflowing molten metal in said weir to stop molten metal flow through said weir and said nozzle means whereby said casting operation may be selectively terminated.

2. The flow control device of claim 1 wherein said weir includes an assembly comprising a dam adjacent the inlet opening to the nozzle means to restrict the flow of metal in a channel and a cap above the inlet opening and said dam to confine a gas back pressure bubble.

3. The flow control device of claim 2 wherein said assembly further includes a skirt depending from the cap to a level below the top of the dam, said skirt and dam forming a channel for controlled feeding of the metal to said nozzle in accordance with the back pressure bubble.

4. The flow control device of claim 3 wherein said dam and skirt are formed along one side of said weir assembly.

5. The flow control device of claim 4 wherein said pressure means includes a gas feed duct extending along the side of said crucible and connecting to said weir assembly.

6. The flow control device of claim 1 wherein is further provided a substrate adjacent the outlet orifice of said nozzle to provide planar flow during the casting mode and provide gas back pressure during the blocking mode.

7. The flow control device of claim 2 wherein the dam is integral with the base of said crucible and separate from said nozzle means.

8. The flow control device of claim 2 wherein the dam is integral with the nozzle.

9. The flow control device of claim 2 wherein the dam extends around the full periphery of said inlet opening of said nozzle means to provide an annular channel for flow of the metal.

10. The flow control device of claim 2 wherein said weir assembly is integral with said nozzle means.

11. The flow control device of claim 10 wherein said cap is semi-spherical providing a hollow dome for said bubble, said dam comprising an indented wall extending upwardly under said dome to form said channel on one side of said weir assembly.

* * * * *